United States Patent [19]

Olson

[11] 4,322,023

[45] Mar. 30, 1982

[54] MATERIAL MOVING APPARATUS

[76] Inventor: David A. Olson, 1708 Roberts Dr., Albert Lea, Minn. 56007

[21] Appl. No.: 58,012

[22] Filed: Jul. 16, 1979

[51] Int. Cl.[3] ..... F04B 19/04; F04B 19/22

[52] U.S. Cl. ..... 222/380; 222/383; 92/162 R; 92/171

[58] Field of Search ..... 92/162 R, 177, 171; 417/551, 900; 222/380, 383, 385

[56] References Cited

U.S. PATENT DOCUMENTS

| | | | |
|---|---|---|---|
| 17,855 | 7/1857 | Gale | 92/162 R |
| 2,878,990 | 3/1959 | Zürcher | 92/162 R |
| 3,103,276 | 9/1963 | Schmitzer | 198/670 X |

FOREIGN PATENT DOCUMENTS

| | | | |
|---|---|---|---|
| 1027163 | 4/1958 | Fed. Rep. of Germany | 92/177 |
| 1277541 | 10/1961 | France | 92/177 |

*Primary Examiner*—David A. Scherbel

*Attorney, Agent, or Firm*—Burd, Bartz & Gutenkauf

[57] ABSTRACT

A material moving apparatus, and in particular, a material moving pump such as a manure pump. The pump includes a pumping chamber defined by interior chamber walls, and a piston or ram mounted for reciprocation in the chamber. The ram has side walls generally in conformance with the shape formed by the interior walls defining the chamber. The side walls of the ram are slotted or provided with grooves which induce turbulence in fluid flow between the side walls of the ram and the interior walls of the chamber to inhibit backflow of material from a position in front of the ram to a position behind the ram. The pump thus operates efficiently to pump material of low viscosity or material of low density.

10 Claims, 8 Drawing Figures

FIG. 1
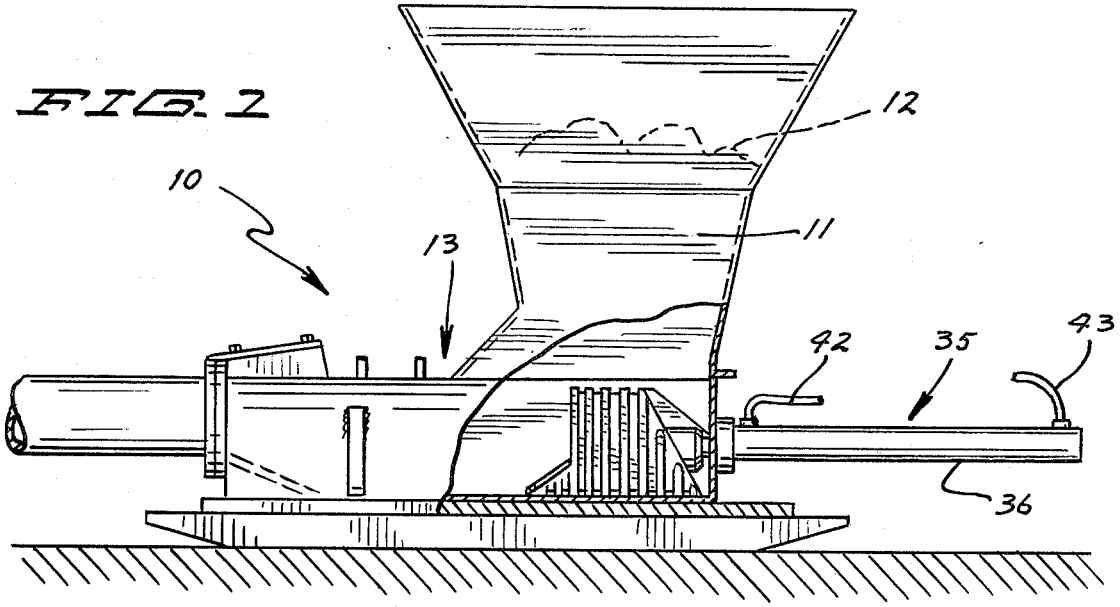
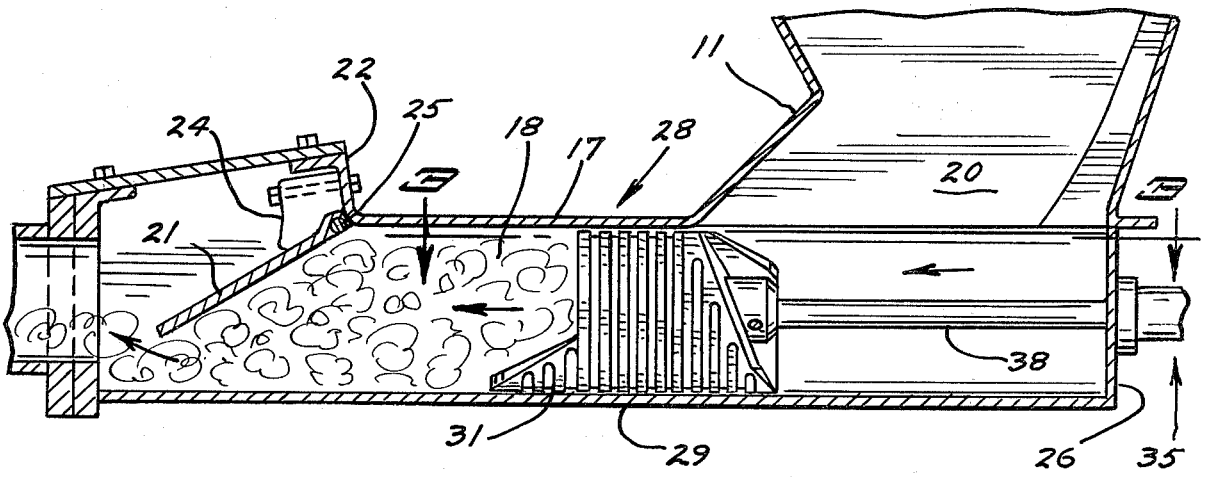
FIG. 2
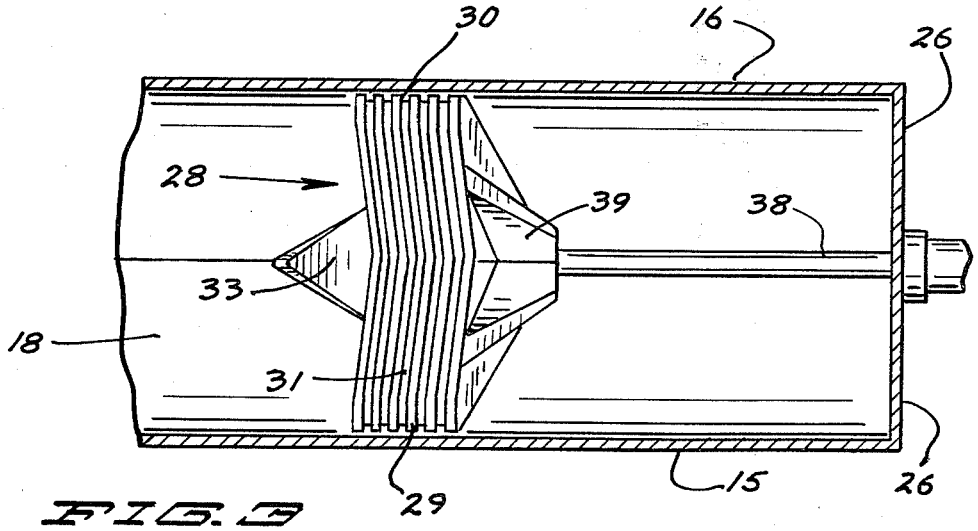
FIG. 3

MATERIAL MOVING APPARATUS

SUMMARY OF THE INVENTION

The invention relates to a liquid pump of the variety used to pump liquid that can be entrained with particulate material such as a manure pump of the type disclosed in U.S. Pat. No. 4,140,443 issued Feb. 20, 1979 to Olson. In such pumps, a ram or piston reciprocates in a chamber undergoing a working stroke or power stroke during which material is moved through a chamber, and a return stroke whereby the ram is returned to its starting position and more material is introduced into the chamber ahead of it. The side walls of the ram generally conform in shape to the interior walls of the chamber and are usually spaced relatively closely to them. Nonetheless, there necessarily exists a clearance space between the ram side wall and the interior chamber wall. Depending on the viscosity of the material or the density of the entrained material being pumped, and upon the pressure head the material is being pumped against, some material is passed between the interior wall of the chamber and the side wall of the ram to a position behind the ram rather than being advanced in the chamber. Under certain conditions of viscosity or low density material, and a high pressure head to pump against, little if any material may be pumped from the chamber. The ram simply reciprocates in the chamber with the material moving from one side of it to the other.

The present invention comprises a material moving apparatus or, more particularly, a material moving pump such as a manure pump. The pump includes a pumping chamber defined by interior chamber walls and a piston or ram mounted for reciprocation in the chamber. The ram has side walls generally in conformance with the shape formed by the interior walls defining the chamber. For purposes of clearance, the side walls of the ram are spaced from the interior wall of the pumping chamber. The side walls are slotted or are provided with grooves which induce turbulence in fluid flow between the side walls of the ram and the interior wall of the chamber. This turbulence inhibits the flow of material to inhibit backflow of the material to a location behind the ram. When the material being pumped is entrained with particulate material, as manure having a high straw or bedding content, the matter can become lodged in the grooves to form a fluid seal which inhibits backflow of material. The pump thus operates efficiently to pump material of low viscosity or material of low density.

IN THE DRAWINGS

FIG. 1 is a side elevational view of a material moving apparatus of the invention shown as a manure pump partly in section functioning to move manure from a collection point to a holding station;

FIG. 2 is an enlarged side elevational view in section of a portion of the manure pump of FIG. 1 showing the ram of the manure pump in an advanced position;

FIG. 3 is a top sectional view of a portion of the manure pump of FIG. 2 taken along the line 3—3 thereof;

DESCRIPTION OF PREFERRED EMBODIMENT

Figure 4:
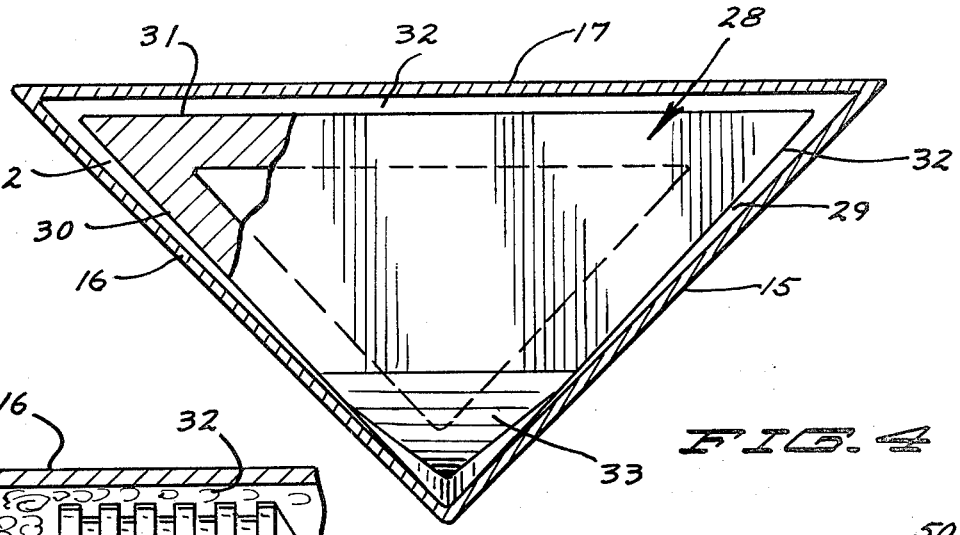
FIG. 4 is a front elevational view of the ram of the manure pump of FIG. 1 located in the pumping chamber.
Figure 5:
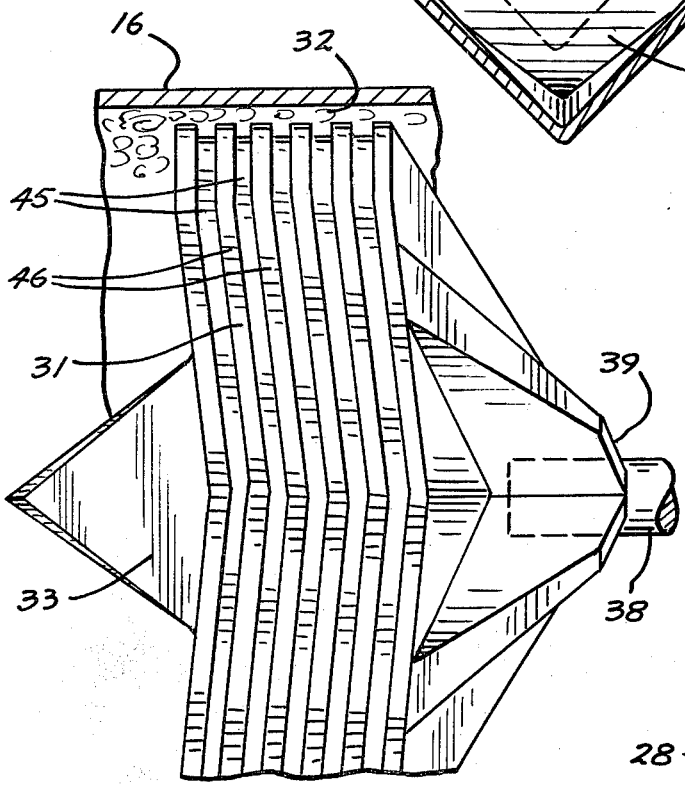
FIG. 5 is a top plan view partly fragmented of the ram of the manure pump of the invention.

Referring to the drawings, there is shown in FIG. 1 a material handling apparatus constituted as a manure pump indicated generally at 10 positioned to receive and collect manure transferred from a cleaning system (not shown) or the like. Manure pump 10 includes an upright hopper 11 containing manure 12 preparatory to being pumped to a holding location. A pump assembly 13 mounted on skids 14 includes a pump housing formed of side walls 15,16 and a top wall 17. The side walls 15,16 converge to a lower apex and are closed at the top by the top wall 17 forming a triangularly shaped housing, as shown in FIG. 4, defining a generally horizontal pumping chamber 18. A rear opening in top wall 17 provides an inlet opening 20 at the rearward end of pumping chamber 18 in contingeous relationship and coextensive with the outlet opening of the collection hopper 11 so that manure is transferrable from the inside of hopper 11 to the pumping chamber 18.

The forward end of pumping chamber 18 is closed by a one-way valve comprised as a closure plate or spring loaded gate 21. Gate 21 is pivoted to an upstanding wall 22 located at the forward end of pumping chamber 18 and extending from top wall 17. Gate 21 extends downwardly and slightly forward from the upstanding wall 22 to the apex of chamber 18 and is shaped to conform to side walls 15,16 when in the closed position. A rubber spring 24 is effective to bias gate 21 towards a closed position. Gate 21 is openable about a pivot 25 against the influence of the rubber spring 24 responsive to the pressure of manure being pressed against it from pumping chamber 18. Manure is pumped past gate 21 into a discharge pipe 27.

The rear of chamber 18 is closed by an end plate 26. A reciprocating plunger or ram 28 is located in pumping chamber 18. Ram 28 has a body portion defined by convergent sides 29,30 and a top 31. The walls of sides 29,30 downwardly converge to a lower apex that fits in the apex of pumping chamber 18. The walls of sides 29,30 extend upwardly and outwardly from the apex of pumping chamber 18 in general conformance to the triangular shaped interior formed by the side walls 15,16 of the pump housing but being spaced from the interior surfaces of the side walls 15,16 for purposes of clearance. The wall of top 31 of ram 28 spans the upper edges of the sides 29,30 and is space slightly from top wall 17 of the pump housing for purposes of clearance. The clearance space between the ram sides and top and the chamber walls is indicated at 32. A front plow-like brace or nose 33 extends forward from the apex of the ram sides 29,30. The top and sides of ram 28 define a front working face 34 shaped substantially in conformance with the cross-sectional shape of pumping chamber 18.

A suitable motor for reciprocation of ram 28 in pumping chamber 18, as shown in FIGS. 1 and 2, includes a double acting hydraulic reciprocating motor 35. Motor 35 has an elongate hydraulic cylinder 36 fastened by suitable means to the end wall 26 of the pump housing.

Figure 7:
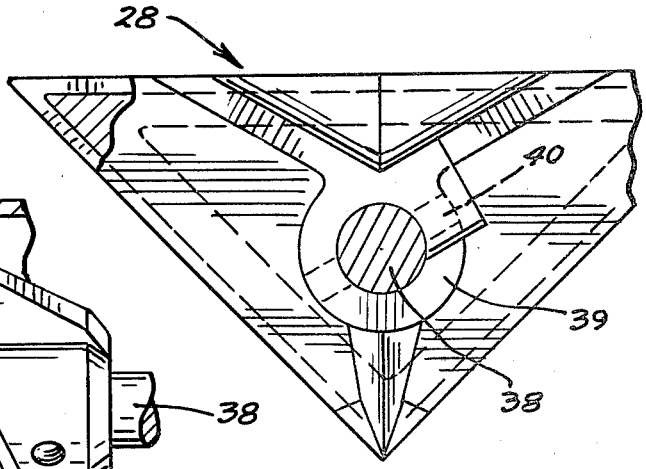
FIG. 7 is a rear elevational view of the ram of the manure pump of FIG. 1.
Figure 6:
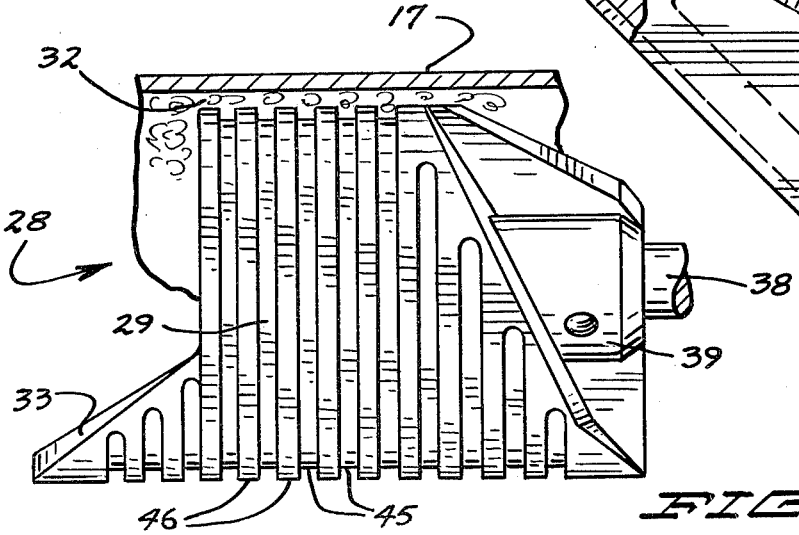
FIG. 6 is an enlarged side elevational view of the ram of the manure pump of FIG. 1.

End wall 26 has an opening co-axial with the axis of cylinder 36 of motor 35. A rod 38 reciprocates in the cylinder 36 and has an end passing through the opening of the end wall 26 for connection to ram 28. The end of rod 38 is engaged in a boss 39 disposed on the rear side of ram 28 (see FIG. 7) and can be secured therein by suitable pin 40. The opposite end of rod 38 is assembled in hydraulic cylinder 36 for reciprocation therein by movement of hydraulic fluid through first and second hydraulic lines 42,43 in usual fashion.

The sides and top of ram 28 have spaced apart, parallel transverse grooves 45 defined by upstanding ridges or ribs 46. Ram 28 has at least one groove 45 but preferably, as shown, has a plurality of such grooves. The grooves 45 are continuous around the sides and top of ram 28 and are orientated transversely or perpendicular to the longitudinal direction of travel of the ram. The ribs 46 are rectangular in cross-section producing rectangular grooves 45, although other shapes could be employed. The bottom side of nose 33 has tranverse grooves. The purpose and effect of the grooves 45 and ribs 46 is to promote turbulence in the flow of material in the clearance space 32 between the sides and top of the ram 28 and the walls defining pumping chamber 18. As the ram 28 advances in chamber 18 during a working stroke, there is relative flow of material or manure between the walls of the sides and top of ram 28 and the interior walls of chamber 18. Manure tends to flow to a position behind the ram 28. This flow is objectionable in that it impedes pumping efficiency. Grooves 45 and ridges 46 promote turbulence in the flow in clearance space 32 which impedes this flow and results in greater pumping efficiency. The pressure drop between the forward face of ram 28 and the rearward face thereof is increased. Material is pumped a greater distance and a larger volume is pumped. Material can be pumped against a greater pressure head. A larger clearance space is permissable without unduly decreasing the efficiency. At times manure being pumped has a high bedding or straw content, or a content of other particulate material. This material can collect in the grooves 45 and extend outward beyond the crest of the ribs 46. This tends also to increase the pumping efficiency as it forms a further restriction of flow in the clearance space 32 and can form a fluid seal which will restrict flow in the clearance space 32.

Figure 8:
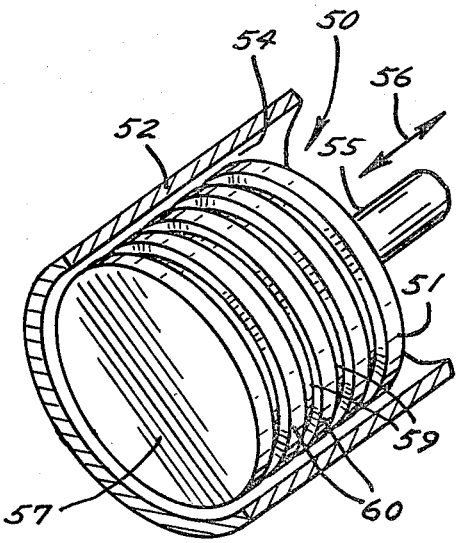
FIG. 8 is a perspective view partly in section of an alternative form of a manure pump ram.

As depicted in FIGS. 1 through 7, ram 28 is generally triangular in cross-sectional shape. The ram can be fabricated of any other advantageous cross-sectional shape. As shown in FIG. 8, a ram indicated generally at 50 has cylindrical side walls 51 and is located in a pumping chamber defined by cylindrical pumping chamber housing walls 52 spaced from the cylindrical side walls 51 by a clearance 54. Ram 50 is connected to a rod 55 for reciprocating movement in the pumping chamber indicated by the arrow 56. Ram 50 has a front working face 57 generally circular in shape. A plurality of continuous, parallel circumferential grooves 59 are located on side walls 51 of ram 50 defined by parallel continuous circumferential ribs 60. Grooves 59 and ribs 60 include turbulence in the flow of material in clearance 54 thus to increase pumping efficiency, enable greater pumping distances and a larger pumping volume, and permit a greater clearance size without unduly decreasing efficiency. The ram can also have a rectangular, square or other advantageous cross-sectional shape.

The embodiments of the invention in which an exclusive property or privilege is claimed are defined as follows:

1. A material moving pump comprising:

a pump housing having interior walls defining a generally horizontally orientated pumping chamber with a rearward end having a material inlet through an upper portion of said walls and a forward end having a material outlet;

a pumping ram located in the pumping chamber and including a body portion having a front working face for movement of material in the pumping chamber transferred to the pumping chamber through the material inlet from the rearward end toward the forward end of the pumping chamber, and having side walls configured to conform substantially to the interior cross-sectional shape provided by the interior walls of the pumping chamber and spaced from the interior walls of the pumping chamber by a clearance space;

a plurality of ribs located on the walls of the ram orientated transversely to the intended direction of travel of the ram forming a plurality of grooves on the walls of said ram;

said ram having forwardly directed nose means, said nose means having means forming at least one groove open toward an interior wall of the pump housing; and means for generally horizontal reciprocation of the ram in the pumping chamber.

2. The material moving pump of claim 1 wherein: said plurality of ribs are orientated transversely on the walls of said ram and are continuous about the walls of said ram forming a plurality of continuous transverse grooves.

3. The material moving pump of claim 2 wherein: said ribs are generally rectangular in shape.

4. The material moving pump of claim 1 or 2 wherein: said pumping chamber is triangular in cross-sectional shape and said ram is triangular in cross-sectional shape.

5. The material moving pump of claim 1 or 2 wherein: said ram is circular in cross-sectional shape and said pumping chamber is circular in cross-sectional shape.

6. A ram for horizontal reciprocal movement in a generally horizontally orientated material moving pumping chamber having interior walls forming a defined interior cross-sectional shape, from a rear end of the chamber to a forward end of the chamber during a working stroke, said ram comprising:

a body portion having a front material moving working face and side walls orientated in configuration to substantially conform to the interior cross-sectional shape of the pumping chamber with a clearance space between the walls of said ram and the interior walls defining said chamber;

a plurality of ribs located on the walls of said ram orientated transversely to the intended direction of travel of the ram in the chamber during a working stroke forming a plurality of transverse grooves on the walls of said ram; and a nose means joined to the body portion, said nose means providing a forward extension of the front working face of the body portion, said nose means having means forming at least one groove open to an outside surface thereof.

7. The ram of claim 6 wherein: said ribs are rectangular in shape.

8. The ram of claim 7 wherein: said ram is triangular in cross-sectional shape.

9. The ram of claim 6 wherein: said ram is circular in cross-sectional shape.

10. The ram of claim 6 wherein: said ribs are continuous along the sides of the body portion forming a plurality of continuous transverse grooves along the sides of the body portion.

* * * * *